US008898960B2

(12) United States Patent
Brochu

(10) Patent No.: US 8,898,960 B2
(45) Date of Patent: Dec. 2, 2014

(54) EAVESTROUGH COVER

(76) Inventor: Stephane Brochu, St-Romuald (CA)

( * ) Notice: Subject to any disclaimer, the term of this patent is extended or adjusted under 35 U.S.C. 154(b) by 175 days.

(21) Appl. No.: 13/068,346

(22) Filed: May 9, 2011

(65) Prior Publication Data

US 2011/0265390 A1 Nov. 3, 2011

Related U.S. Application Data

(63) Continuation-in-part of application No. 11/827,738, filed on Jul. 13, 2007, now abandoned.

(51) Int. Cl.
*E04D 13/00* (2006.01)
*E04D 13/076* (2006.01)

(52) U.S. Cl.
CPC ..... *E04D 13/076* (2013.01)
USPC ..... 52/12; 52/11; 52/15

(58) Field of Classification Search
CPC ..... E04D 13/076; E04D 13/0481; E04D 13/0725; E04D 2013/0486
USPC ..... 52/12, 11, 13, 14, 15
See application file for complete search history.

(56) References Cited

U.S. PATENT DOCUMENTS

| | | | | |
|---|---|---|---|---|
| 6,543,729 | B1 * | 4/2003 | Ylonen | 248/48.1 |
| 6,786,008 | B2 * | 9/2004 | Brochu | 52/12 |
| 7,278,239 | B1 * | 10/2007 | West | 52/12 |
| 2004/0182014 | A1 * | 9/2004 | Brochu | 52/12 |
| 2005/0204642 | A1 * | 9/2005 | Valentini | 52/12 |
| 2006/0037255 | A1 * | 2/2006 | Brochu | 52/14 |
| 2006/0048456 | A1 * | 3/2006 | Iannelli | 52/13 |
| 2008/0190039 | A1 * | 8/2008 | Brochu | 52/12 |
| 2008/0289263 | A1 * | 11/2008 | Brochu | 52/12 |
| 2009/0013612 | A1 * | 1/2009 | Brochu | 52/12 |

* cited by examiner

*Primary Examiner* — Joshua J Michener
*Assistant Examiner* — Matthew Gitlin
(74) *Attorney, Agent, or Firm* — Eric Fincham

(57) ABSTRACT

An eavestrough having a front wall, rear wall and top wall with a foraminous membrane extending between the rear wall and front wall, and a recess formed between the eavestrough top wall and the foraminous membrane which permits reversal of water flow flowing towards the recess.

5 Claims, 2 Drawing Sheets

EAVESTROUGH COVER

This application is a continuation in part application of application Ser. No. 11/827,738 filed Jul. 13, 2007 now abandoned.

FIELD OF THE INVENTION

The present invention relates to eavestroughs or gutters, and more particularly, relates to improvements in a cover portion thereof.

BACKGROUND OF THE INVENTION

Eavestroughs are widely used to collect rainwater from the roof of a building and direct the same away from the building and in particular the foundation thereof. The eavestrough also protects the soil proximate to the building from erosion by the rainwater dripping from the roof.

One problem with eavestroughs is the collection of debris therein. In order to obliviate this problem, it is known in the art to provide a shield or cover which will permit passage of rainwater from the roof to the eavestrough while the same from extraneous foreign matter such as leaves and the like.

Different approaches have been taken as to how the shield, cover or membrane is secured to the eavestrough. Other approaches have also been taken such as mounting the eavestrough for rotatable movement such that they may be emptied at desired intervals. A still further approach is one wherein a cover has an outer edge which curls downwardly and the water flow follows a curved portion due to surface tension and thereafter cascades into the eavestrough. Theoretically, any leaves and the like do not enter as they would continue to fall to the ground. However, when large volumes of water are encountered, the surface tension is generally insufficient to cause all of the rainwater to flow into the eavestrough.

When utilizing the cover or guard, there has to be a balance between having a large enough surface area which is apertured to permit all the rainwater to flow into the eavestrough even during of very heavy rainfall. Many designs fail to accommodate all of the rainfall leading to overflowing of the eavestrough.

SUMMARY OF THE INVENTION

It is an object of the present invention to provide an eavestrough cover wherein overflow is prevented and the water is directed to a central portion of the eavestrough.

According to one aspect of the present invention, there is provided an eavestrough having an eavestrough front wall, an eavestrough rear wall, an eavestrough top wall, an eavestrough bottom wall, and a foraminous membrane extending between the eavestrough rear wall and the eavestrough front wall, the improvement comprising a recess formed between the eavestrough top wall and the foraminous membrane, the recess having a reverse C-shaped configuration of a continuous arcuate nature, the recess extending inwardly of the eavestrough top wall to thereby permit the reversal of water flow flowing towards the recess by the water flow following the contour of the recess.

The present invention provides a guard for the eavestrough which prevents foreign matter from entering into the eavestrough. It is important that appropriate sizing of the apertures formed in the guard is provided. Thus, the apertures' size and their placement permit adequate drainage of the water through the apertures into the eavestrough while substantially excluding any foreign matter which remains on the top and which will normally be removed by the wind or the like.

The apertures preferably extend in diagonal rows at an angle of 45° with respect to the eavestrough length. In preferred embodiments, the apertures have an aperture size of between 2.5 and 10 mm and even more preferably between about 3.0 and 4.0 mm. As the apertures are arranged in diagonal rows, they are also preferably arranged in longitudinally extending rows. In a longitudinally extending row, the apertures are spaced apart by a distance between 10 and 15 mm while in a diagonal row they are spaced apart by a distance of between 5 and 10 mm.

As will be appreciated, during a period of heavy rain or the like, the drainage may not be instantaneous and accordingly, there are provided walls on either side to prevent overflow. Moreover, adjacent the eavestrough front wall (the rear wall being adjacent the building eave), there is provided a recess which extends inwardly of the eavestrough top wall and has a generally U-shaped configuration to thereby permit reversal of heavy water flow coming from the roof.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 2:
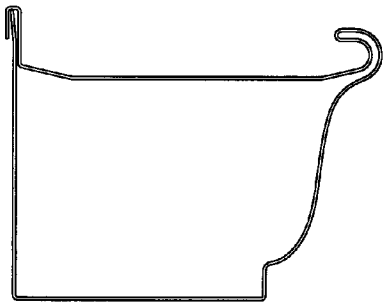
FIG. 2 is a side elevational view of the eavestrough.
Figure 3:
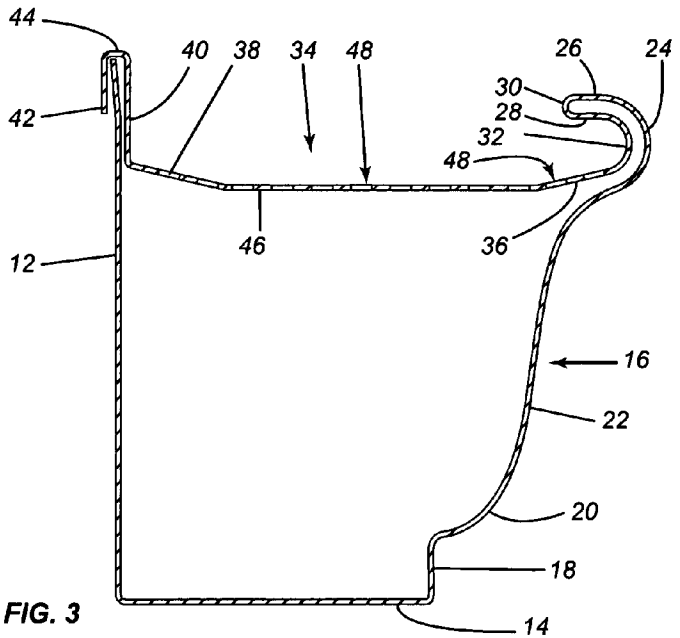
FIG. 3 is a cross-sectional view thereof.
Figure 1:
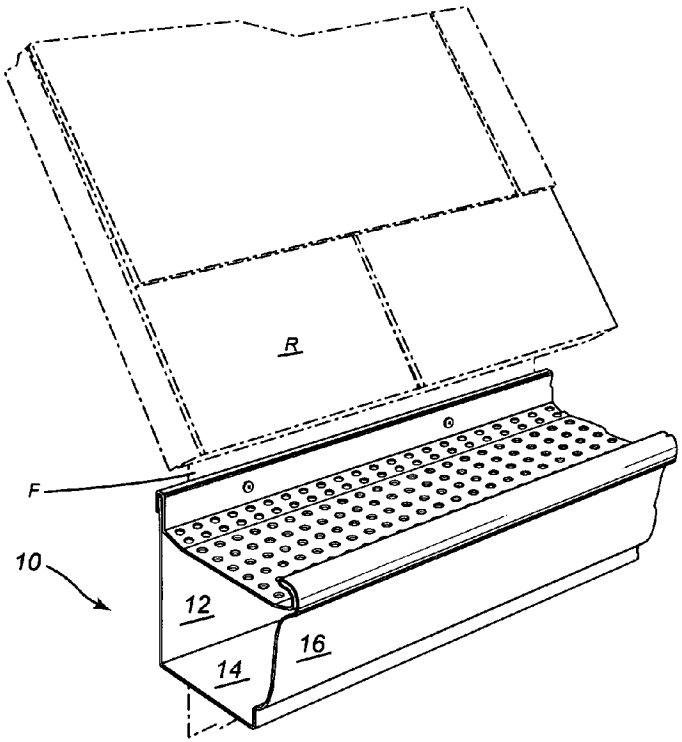
FIG. 1 is a perspective view of a portion of an eavestrough attached to the facia of a roof structure.

Referring to the drawings in greater detail and by reference characters thereto, there is illustrated in FIG. 1 an eavestrough generally designated by reference numeral 10 and which eavestrough is attached to the facia F of a roof R.

Eavestrough 10 is shown as being of a monocoque design and includes an eavestrough rear wall 12, an eavestrough bottom wall 14, and an eavestrough front wall generally designated by reference numeral 16.

Eavestrough front wall 16, as is conventional in the art, includes a lower vertical portion 18, a lower arcuate portion 20, a middle portion 22 and an upper arcuate portion 24. In the illustrated embodiment, upper arcuate portion 24 merges with a top wall designated by reference numeral 26. Subsequently, the top wall continues through bight 30 to form a lower horizontal wall 28. Subsequently, a U or C-shaped section 32 is provided and which U or C-shaped section 32 defines a recess.

A top membrane or cover is generally designated by reference numeral 34 and includes a diagonally sloping wall section 36 located at the bottom of C-shaped section 32 and an upwardly extending diagonal section 38 on the opposite side thereof. There is also a substantially planar portion 46 centrally located. A plurality of apertures 48 are provided within sections 36, 38 and 46.

There is also provided an upwardly extending wall section 40 which lies parallel to eavestrough rear wall 12 and which extends over the top thereof through bight 44 and a downwardly extending vertical wall section 42. A plurality of dimples 48 are provided to ensure a grip between wall section 40 and eavestrough rear wall 12.

Figure 4:
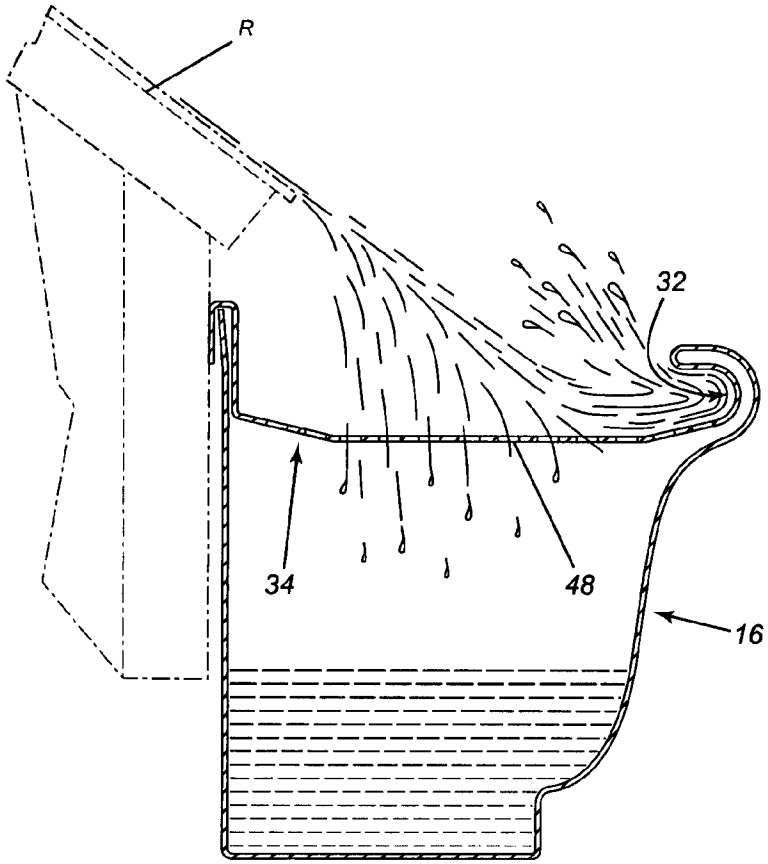
FIG. 4 is a side schematic view illustrating the functioning of the eavestrough of the present invention.

In use, and as may be seen in FIG. 4, water flow is directed onto upper membrane 34. During periods of heavy rain, the water will flow towards C-shaped section 32 wherein the water flow will be reversed and the water directed towards the other side of the eavestrough. Thus, the full surface of the membrane 34 will function to permit the water to fall through apertures 48 at a rate designed to drain all the water.

Figure 5:
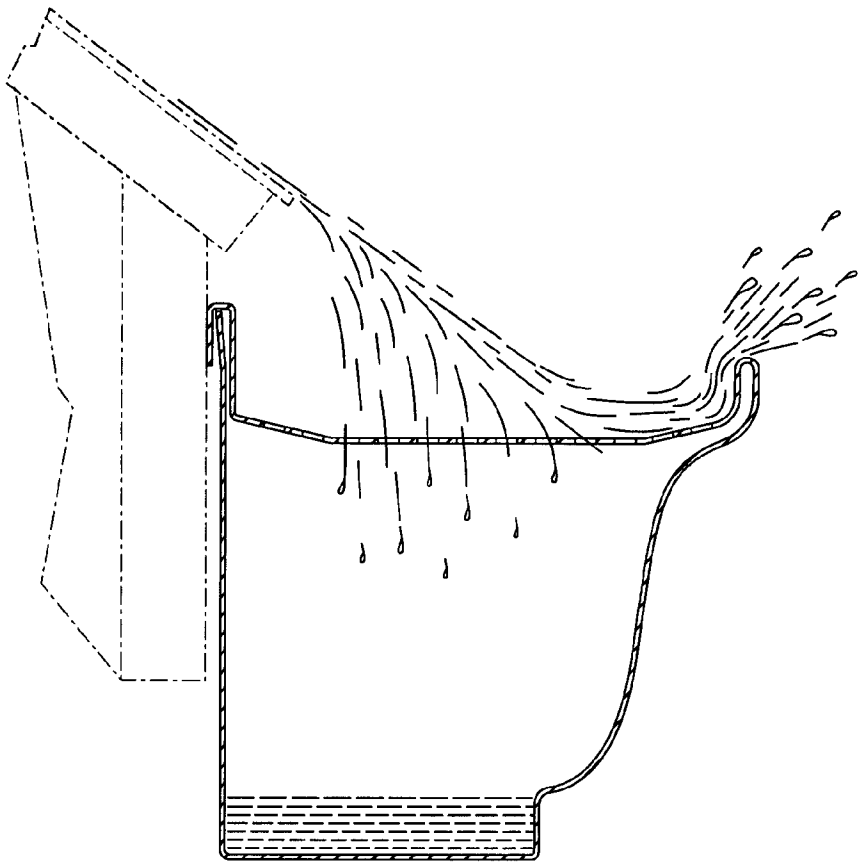
FIG. 5 is a side schematic sectional view of the functioning of an eavestrough not having the ability to reverse the water flow.

With eavestroughs having a conventional configuration, and as may be seen in FIG. 5, the water flow will be sufficient to hit the wall and go past the edge of the eavestrough.

It will be understood that the above described embodiment is for purposes of illustration only and that changes and modifications may be made thereto without departing from the spirit and scope of the invention. Thus, the eavestrough and foraminous membrane may be formed of individual components suitably secured together.

I claim:

1. An eavestrough having an eavestrough front wall, an eavestrough rear wall, an eavestrough top wall, an eavestrough bottom wall, and a foraminous membrane extending between said eavestrough rear wall and said eavestrough front wall, the improvement wherein membrane has a planar central portion, a first upwardly extending side portion connected to said planar central portion, a recess extending between said eavestrough top wall and said foraminous membrane, said recess connected to said first upwardly extending side portion, said recess having a reverse C-shaped configuration of a continuous arcuate nature, said recess extending inwardly of said eavestrough top wall to thereby permit the reversal of, water flow flowing towards said recess by said water flow following the contour of said recess thereby flowing upwardly and being directed towards said planar central portion.

2. The eavestrough of claim 1 wherein said eavestrough and said foraminous membrane are a single unitary member.

3. The eavestrough of claim 1 wherein said foraminous membrane has a U-shaped structure adjacent said eavestrough rear wall, said U-shaped structure enclosing an upper portion of said eavestrough rear wall.

4. The eavestrough of claim 3 wherein said foraminous membrane has a second upwardly extending side portion intermediate said U-shaped structure and said planar central portion.

5. The eavestrough of claim 4 wherein said eavestrough is formed of a metallic material.

* * * * *